US008826992B2

(12) United States Patent
Zhou

(10) Patent No.: US 8,826,992 B2
(45) Date of Patent: Sep. 9, 2014

(54) CIRCULATION AND ROTATION TOOL

(75) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 562 days.

(21) Appl. No.: 13/085,039

(22) Filed: Apr. 12, 2011

(65) Prior Publication Data

US 2012/0261138 A1 Oct. 18, 2012

(51) Int. Cl.

| | |
|---|---|
| ***E21B 19/00*** | (2006.01) |
| ***E21B 19/16*** | (2006.01) |
| ***E21B 21/10*** | (2006.01) |

(52) U.S. Cl.

CPC ..... *E21B 21/106* (2013.01); *E21B 19/16* (2013.01)

USPC ..... 166/376; 166/85.1

(58) Field of Classification Search

USPC ..... 166/379, 78.1, 85.1, 90.1, 95.1

See application file for complete search history.

(56) References Cited

U.S. PATENT DOCUMENTS

| | | | |
|---|---|---|---|
| 1,491,986 | A | 4/1924 | Greene |
| 1,541,669 | A | 6/1925 | Summers |
| 1,718,998 | A | 7/1929 | Carroll |
| 1,749,946 | A | 3/1930 | Kaough |
| 1,759,275 | A | 5/1930 | Powell |
| 2,144,146 | A | 1/1939 | Driscoll |
| 2,153,770 | A | 4/1939 | Nixon |
| 2,156,384 | A | 5/1939 | Fluellen |
| 2,143,849 | A | 7/1939 | Gordy |
| 2,527,954 | A | 10/1950 | Nixon |
| 2,542,302 | A | 2/1951 | Barker |
| 4,253,219 | A | 3/1981 | Krasnov |
| 4,463,481 | A | 8/1984 | Rastetter et al. |
| 4,469,201 | A | 9/1984 | Rastetter et al. |
| 5,609,226 | A | 3/1997 | Penisson |
| 5,848,647 | A | 12/1998 | Webre et al. |
| 6,119,772 | A | 9/2000 | Pruet |
| 6,138,776 | A | 10/2000 | Hart et al. |

(Continued)

FOREIGN PATENT DOCUMENTS

WO 2011026035 A2 3/2011

OTHER PUBLICATIONS

PCT Notification of Transmittal of the International Search Report and the Written Opinion of the International Searching Authority, or the Declaration; dated Jun. 18, 2013; International Application No. PCT/US2012/030329; International File Date: Mar. 23, 2012.

Weatherford "Continuous Flow Sub System", Jun. 23, 2009, available at http://dea-global.org/wp-content/uploads/2009/10/D-Pavel-DEA-presentation-June-2009.pdf.

(Continued)

*Primary Examiner* — Kenneth L Thompson
*Assistant Examiner* — Michael Wills, III
(74) *Attorney, Agent, or Firm* — Bracewell & Giuliani LLP; Constance G. Rhebergen; Taylor P. Evans

(57) ABSTRACT

A tool circulates drilling fluid through and rotates a pipe string while making up or breaking out a stand of pipe. The tool includes a tubular member defining a central bore having an axis, wherein the tubular member comprises an upper tubular member and a lower tubular member, and wherein the upper tubular member and the lower tubular member are configured to alternately rotate independently and in unison. The tool also includes a central bore valve coupled to the upper member, and at least one radial valve coupled to the upper tubular member axially below the central bore valve.

20 Claims, 15 Drawing Sheets

(56) References Cited

U.S. PATENT DOCUMENTS

| | | | | |
|---|---|---|---|---|
| 6,244,345 | B1 * | 6/2001 | Helms | 166/301 |
| 6,640,939 | B2 | 11/2003 | Buck | |
| 6,668,684 | B2 | 12/2003 | Allen et al. | |
| 6,739,397 | B2 | 5/2004 | Ayling | |
| 6,820,705 | B2 | 11/2004 | Baugh | |
| 6,994,628 | B2 * | 2/2006 | Boyd | 464/163 |
| 7,510,007 | B2 * | 3/2009 | Robichaux et al. | 166/291 |
| RE41,759 | E * | 9/2010 | Helms | 166/301 |
| 7,857,058 | B2 * | 12/2010 | Tulloch et al. | 166/311 |
| 8,381,840 | B2 * | 2/2013 | Nielsen et al. | 175/113 |
| 2002/0134555 | A1 * | 9/2002 | Allen et al. | 166/377 |
| 2006/0278434 | A1 | 12/2006 | Calderoni et al. | |
| 2006/0289154 | A1 * | 12/2006 | Robichaux et al. | 166/85.1 |
| 2008/0087430 | A1 * | 4/2008 | Robichaux et al. | 166/285 |
| 2010/0084142 | A1 | 4/2010 | Calderoni et al. | |
| 2011/0155379 | A1 * | 6/2011 | Bailey et al. | 166/324 |

OTHER PUBLICATIONS

Angelo Calderoni and Giorgio Girola, "Eni Managed Pressure Drilling with Uninterrupted Mud Circulation: Technical Update after the First Year's Activity," International Petroleum Technology Conference, Dec. 7-9, 2009.

A. Torsvoll, P. Horsrud, and N. Reimers, "Continuous Circulation During Drilling Utilizing a Drillstring Integrated Valve—The Continuous Circulation Valve," IADC/SPE Drilling Conference, Feb. 21-23, 2006.

L.J. Ayling, J.W. Jenner, H. Elkins, "Continuous Circulation Drilling," Offshore Technology Conference, May 6-9, 2002.

"Non Stop Driller Subs," Managed Pressure Operations, available at http://www.managed-pressure.com.

"Continuous Flushing Drilling," ISD & PCO, Kasab International.

* cited by examiner

CIRCULATION AND ROTATION TOOL

BACKGROUND OF THE INVENTION

1. Field of the Invention

The present invention relates in general to making up and breaking out pipe connections during drilling operations and, in particular, to a tool for allowing circulation of fluid through and rotation of a pipe string while making up or breaking out pipe connections.

2. Brief Description of Related Art

In conventional drilling operations, well bores are drilled with a drill bit on the end of a pipe string that is rotated by means of a rotary table or a top drive. The top drive is coupled to the upper end of the pipe string and provides the necessary torque to rotate the drill bit for continued drilling. Typically, a pump circulates drilling mud through the top drive and down the pipe string to the drill bit during drilling operations. Continued pumping through the top drive forces the drilling mud at the bottom of the wellbore back up the wellbore on the outside of the pipe string, where the drilling mud returns to a drilling mud tank system. The circulating drilling mud cools and cleans the drill bit, bringing the debris and cuttings produced by the drilling process to the surface of the wellbore. Continued drilling draws the pipe string further into the wellbore, eventually requiring another stand of pipe to be added to the pipe string.

In most prior art drilling methods, when a new stand is added to or removed from the pipe string, rotation of the pipe string, and thus drilling, must cease for the duration of the period needed to complete the new joint make up. Prolonged periods without rotation causes prolonged static contact between the formation surrounding the pipe string and the pipe string. This static contact increases the risk of the pipe string becoming stuck in the wellbore. A stuck pipe string causes significant problems for the drilling operation that must be overcome at great expense of time and money. Therefore, there is a need for a device that allows for continuous or nearly continuous rotation of the pipe string while making up or breaking out a new stand.

Circulation of the drilling mud through the pipe string must also cease for the duration of the period needed to add a stand to or remove a stand from the pipe string. When circulation of drilling mud stops, the pressure on the wellbore can significantly decrease. This can cause sections of the wellbore to cave in, or allow the higher pressure of the surrounding formation to cause a blowout of the well. Particularly in a blowout event, this can cause significant risk to property and life. In addition, the cuttings or other debris produced by the drilling process that are carried up and out of the wellbore by the drilling mud may settle when circulation stops, binding the drill bit or causing the pipe string to become stuck. Again, a bound drill bit or stuck pipe string can cause significant problems for the drilling operation that must be overcome at great expense of time and money. Therefore, there is a need for a device that provides continuous or nearly continuous circulation of drilling mud through the pipe string during stand make up or break out.

Various attempts to overcome the problems associated with pipe string make up and break out have been tried. For example, some prior art devices couple a cylinder type device around the pipe string and stand to be joined. The devices employ various sealing elements to alternately close off the pipe string or the stand during make up or break out. Drilling mud circulates into the pipe string through a connection at the cylinder while the stand is being made up or broken out, allowing for continuous circulation. Typically, the devices are quite complex and, to properly operate the device, necessitate the addition of costly and space consuming equipment to the drilling rig. In addition, while these devices continue circulation of the drilling mud, they cannot maintain rotation of the pipe string while a new stand is made up or broken out. Their inability to maintain rotation continues to cause stuck pipe string problems.

Other attempts to overcome these problems couple an element inline with the pipe string at every new stand; the element providing an alternate drilling mud circulation path. These elements provide a coupling for a drilling mud circulation device to attach to during stand make up or break out. The elements typically contain a valve at an upper end of the element that directs drilling mud flow down the pipe string and not back up the new stand when drilling mud circulates along the alternate circulation path. In this manner, these inline elements achieve continuous circulation through the pipe string. However, as above, the inline elements do not provide a solution to achieve continuous rotation. Therefore, there is a need for a device that can maintain continuous circulation and rotation during make up or break out of a stand.

SUMMARY OF THE INVENTION

These and other problems are generally solved or circumvented, and technical advantages are generally achieved, by preferred embodiments of the present invention that provide a circulation and rotation tool, and a method for using the same.

In accordance with an embodiment of the present invention, a circulation and rotation tool (CRT) for connection into a drill pipe string comprises a sub defining a central bore having an axis, the sub having upper and lower ends for connection into a drill pipe string. The sub further comprises an upper tubular member and a lower tubular member. The upper tubular member and the lower tubular member are configured to selectively rotate independently and in unison. The sub includes a central bore valve coupled to the upper tubular member to selectively open and close the central bore, and at least one side entry port in a sidewall of the upper tubular member axially below the central valve for selectively allowing drilling fluid to be injected into the central bore.

In accordance with another embodiment of the present invention, an improvement is located in a drilling rig having a top drive configured to pass drilling fluid through and rotate a pipe string. The improvement comprises a rotary table mounted in the drilling rig below the top drive, wherein the rotary table is configured to suspend and rotate the pipe string. The improvement also includes a sub defining a central bore having an axis, the sub coupled into the pipe string. The sub comprises an upper tubular member and a lower tubular member. The upper tubular member and the lower tubular member are configured to selectively rotate independently and in unison. The sub further comprises a central bore valve coupled to the upper tubular member to selectively open and close the central bore. In addition, the sub comprises at least one side entry port in a sidewall of the upper tubular member axially below the central valve for selectively allowing drilling fluid to be injected into the central bore. The side entry port comprises a check valve that when depressed, allows drilling fluid to be injected through the side entry port into the central bore. Bearings are located between the upper and lower tubular members. Finally, the sub includes an anti-rotation member accessible from an exterior of the sub for selectively locking the upper and lower tubular members together for rotation therewith.

In accordance with yet another embodiment of the present invention, a method for circulating fluid through a drill pipe string supported by a rig drive of a drilling rig while rotating the drill pipe string during make up or break out comprises connecting a circulation and rotation tool (CRT) to a top of each drill pipe stand used to form a drill pipe string, the CRT having upper and lower portions that are selectively rotatable independently of each other. The method continues by lowering the drill pipe string with the rig drive until the CRT is proximate to and above a rotary table of the drilling rig. The method continues to rotate and pump drilling fluid through the rig drive and drill pipe string. Next, the method engages the drill pipe string in the rotary table, and then, rotates the drill pipe string and the lower portion of the CRT with the rotary table while the upper portion of the CRT remains stationary. The method then proceeds by closing a central bore valve of the CRT to block flow of fluid from the rig drive, and then stabbing an injection tube into a side entry port of the upper portion of the CRT and circulating fluid through the CRT and the drill pipe string. Next, the method decouples the rig drive from the CRT, and then, couples another section of pipe between the rig drive and the CRT. Finally, the method disengages the pipe string from the rotary table, and continues operations with the rig drive.

An advantage of a preferred embodiment is that the apparatus provides a circulation and rotation tool for use with top drive systems that can circulate fluid through a pipe string while continuing to rotate the pipe string during stand make up or break out. This diminishes problems associated with stuck pipe strings and drill bits due to static contact between the pipe string and the wellbore.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, materials, and the like have been omitted inasmuch as such details are not considered necessary to obtain a complete understanding of the present invention, and are considered to be within the skills of persons skilled in the relevant art.

Figure 1A:
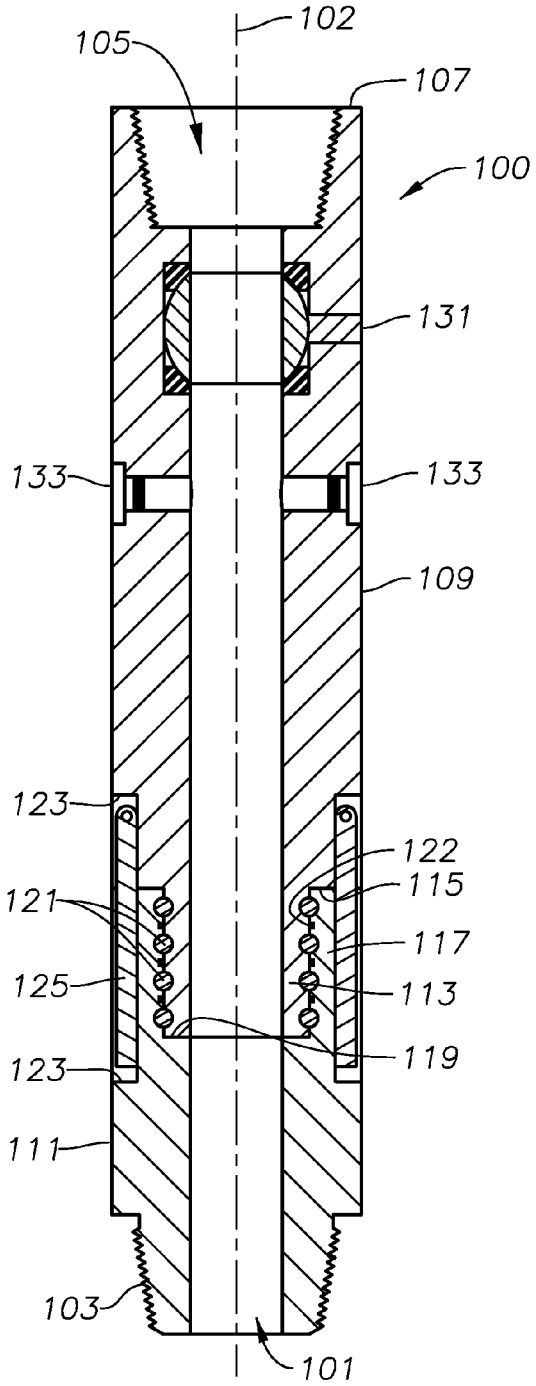
FIG. 1A is schematic sectional view of a circulation and rotation tool (CRT) in accordance with an embodiment of the present invention.

Referring to FIG. 1A, a circulation and rotation tool (CRT) 100 comprises a tubular member defining a central bore 101 having an axis 102. As illustrated, CRT 100 comprises a tapered lower end 103 configured to couple to an upper end of a tubular element. Preferably, an exterior surface of tapered lower end 103 comprises threads. CRT 100 further defines a conical recess 105 extending from an upper end 107 of CRT 100 toward lower end 103. Recess 105 has a larger diameter at the upper end 107 and extends to a narrower diameter a predetermined length from the upper end 107. Preferably, a surface of recess 105 comprises threads allowing a subsequent tubular element to couple to CRT 100. A person skilled in the art will understand that any suitable means for coupling lower end 103 and upper end 107 to tubular elements are contemplated and included in the disclosed embodiments.

CRT 100 further comprises an upper tubular member 109 and a lower tubular member 111. Upper tubular member 109 and lower tubular member 111 are coaxial with axis 102 and upper tubular member 109 is above lower tubular member 111. Upper tubular member 109 comprises an inner annular protrusion 113 proximate to lower tubular member 111. Inner annular protrusion 113 extends from a downward facing shoulder 115 of upper tubular member 109 toward lower end 103. Inner annular protrusion 113 has an inner diameter surface that defines a portion of central bore 101. Downward facing shoulder 115 extends radially from a base of inner annular protrusion 113 to an exterior surface of upper annular member 109.

Lower tubular member 111 comprises an outer annular protrusion 117 adjacent to inner annular protrusion 113. Outer annular protrusion 117 extends from an upward facing shoulder 119 of lower tubular member 111 to and abutting downward facing shoulder 115. Similarly, inner annular protrusion 113 abuts upward facing shoulder 119. Outer annular protrusion 117 has an outer diameter surface that defines a portion of the exterior of lower tubular member 111. Upward facing shoulder 119 extends from a base of outer annular protrusion 117 radially inward to central bore 101. Outer annular protrusion 107 defines a cylindrical receptacle in which inner annular protrusion 113 is located.

A surface of inner annular protrusion 113 opposite central bore 101 abuts an interior surface of outer annular protrusion 117 opposite the exterior surface of lower tubular member 111, such that the combined thickness of inner annular protrusion 113 and outer annular protrusion 117 is equivalent to a wall thickness of CRT 100. Interposed between inner and outer annular protrusions 113, 117 are a plurality of bearings 121. Bearings 121 are configured to allow lower tubular member 111 and upper tubular member 109 to rotate about the central bore 101 independently of each other while sealing the boundary between the inner annular protrusion 113 and the outer annular protrusion 117. In the exemplary embodiment, bearings 121 are rolling element type bearings such as ball bearings. The exemplary bearings are formed of a high quality grade steel, such as G-105 or S-135 grade steel, or similar. Bearings 121 provide some weight bearing capability such that when upper tubular member 109 is lifted vertically, upper tubular member 109 will not lift free of lower tubular member 111. Other embodiments may employ alternative bearing types such as plain type or fluid type bearings. If desired, bearings 121 may be removed for re-dressing and replacement; however, due to the short working duration of bearings 121, it is not anticipated that re-dressing or replacement will be necessary.

A person skilled in the art will understand that any suitable sealing mechanism may be used to seal at bearings 121. In the exemplary embodiment, a seal is formed by placing elastomer o-ring seals 122 between each row of bearings 121. As shown in FIGS. 1A, 1B, 2C and 3, three elastomer o-ring seals 122 are used. Alternative embodiments may use a labyrinth seal between in inner and outer annular protrusions 113, 117, or any other suitable sealing mechanism may be used. If desired, seals 122 may be removed for re-dressing and replacement; however, due to the short working duration of seals 122, it is not anticipated that re-dressing or replacement will be necessary.

Figure 1B:
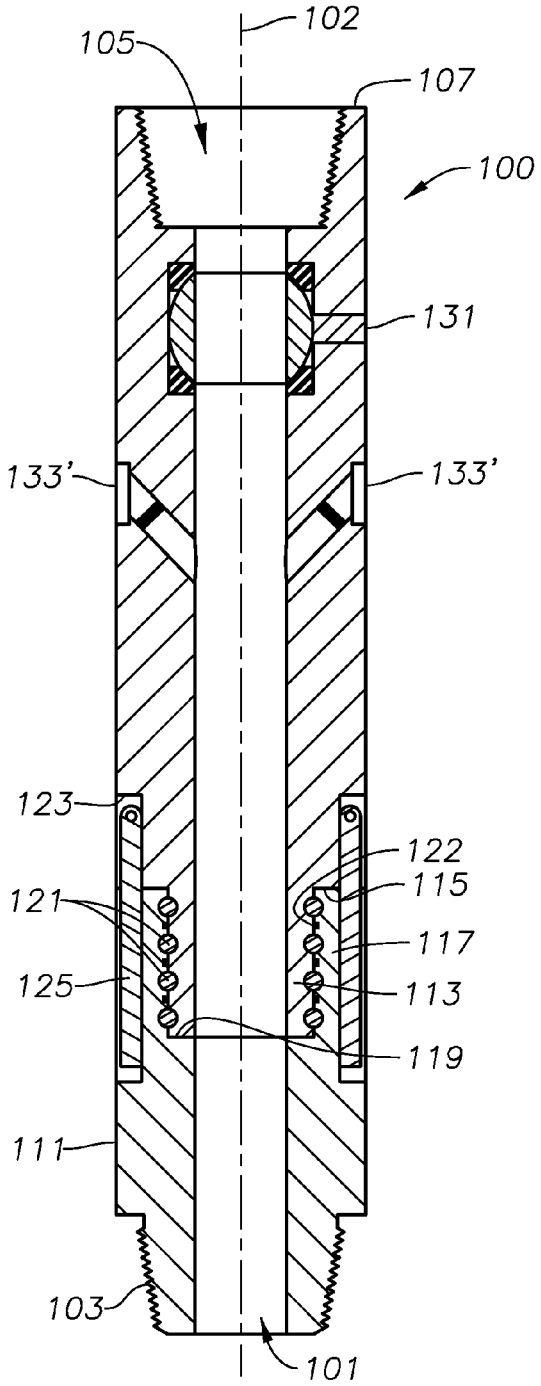
FIG. 1B is a schematic sectional view of a CRT in accordance with an alternative embodiment of the present invention.

Upper and lower tubular members 109, 111 further define annular recesses 123 extending across a boundary between the upper and lower tubular members 109, 111. Annular recesses 123 extend from a surface of inner and outer tubular members 109, 111 radially inward toward central bore 101. Recesses 123 are of a shape such that corresponding engaging devices, described in more detail below, will mount substantially flush within recesses 123. Preferably, the engaging devices, such as locking arms 125, couple to the upper tubular member 109 at an end of recesses 123 within upper tubular member 109. Locking arms 125 may then pivot between an engaged position as shown in FIGS. 1A, 1B, 2A, and 2B or a disengaged position as shown in FIGS. 2C and 3. Persons skilled in the art will understand a preferred embodiment includes two recesses 123 and locking arms 125, but that the present invention contemplates and includes embodiments with more and fewer recesses 123 and locking arms 125.

Figure 2A:
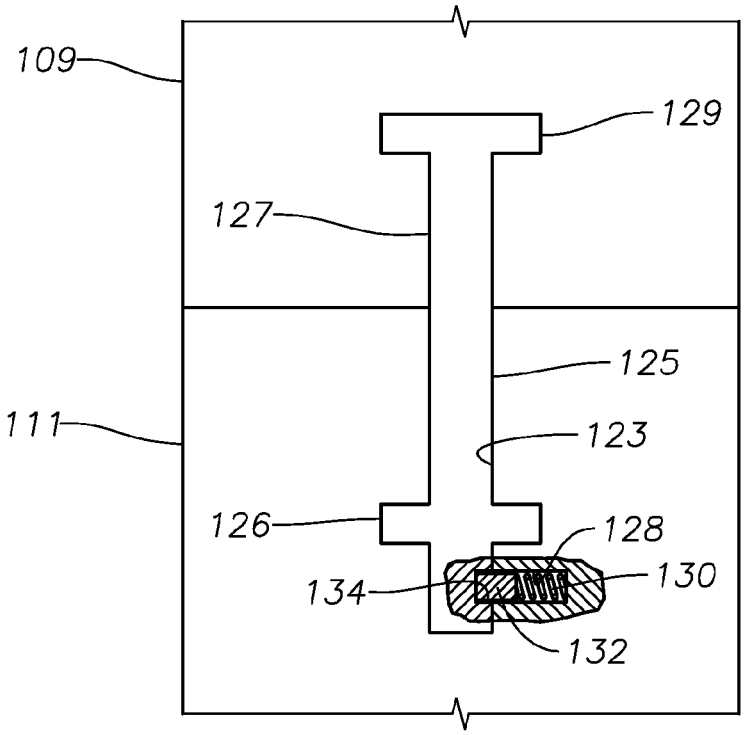
FIGS. 2A-2B are side views of a portion of the CRT of FIG. 1.
Figure 2B:
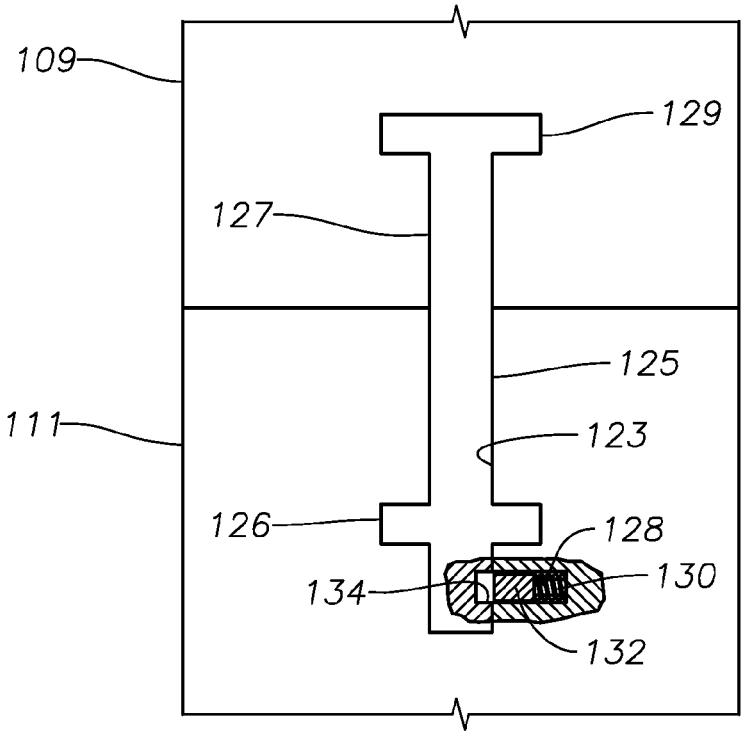
Figure 2C:
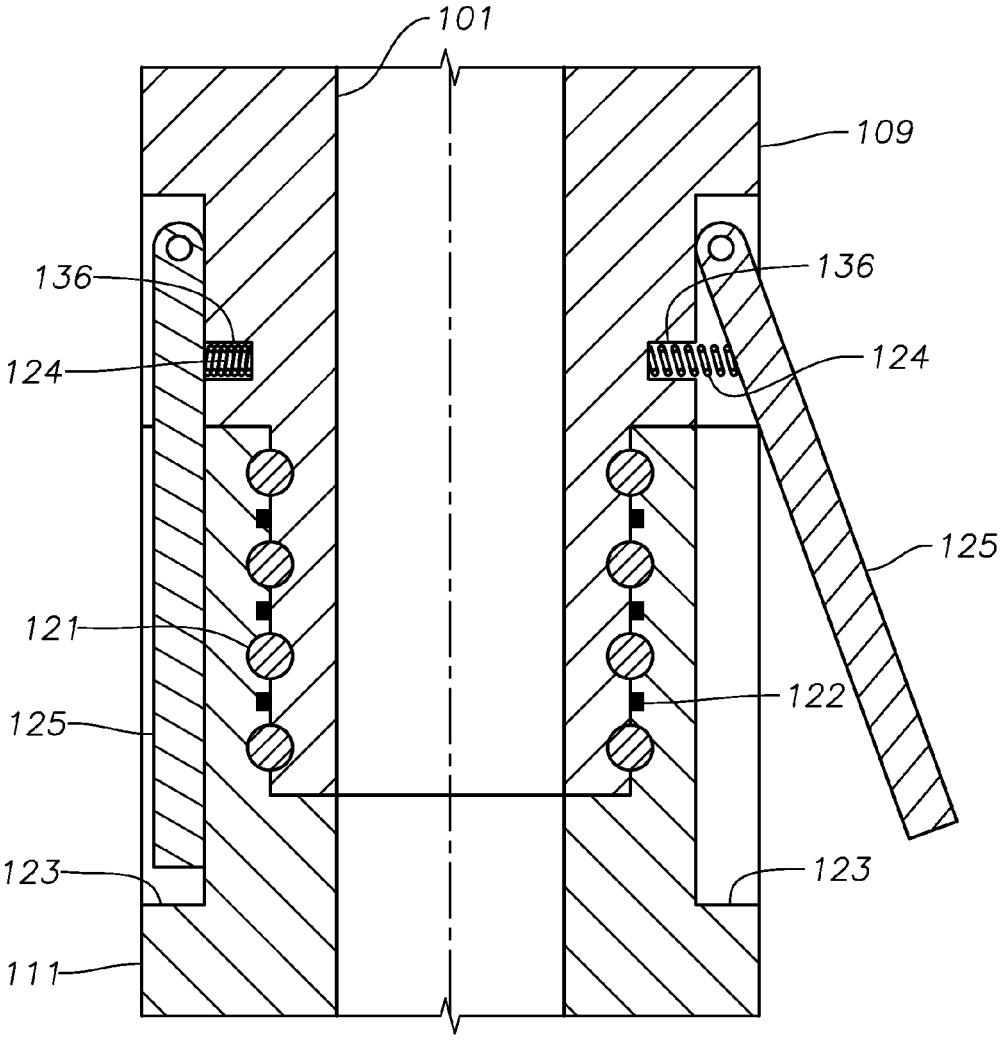
FIG. 2C is a partial sectional view of the CRT of FIG. 1.
Figure 3:
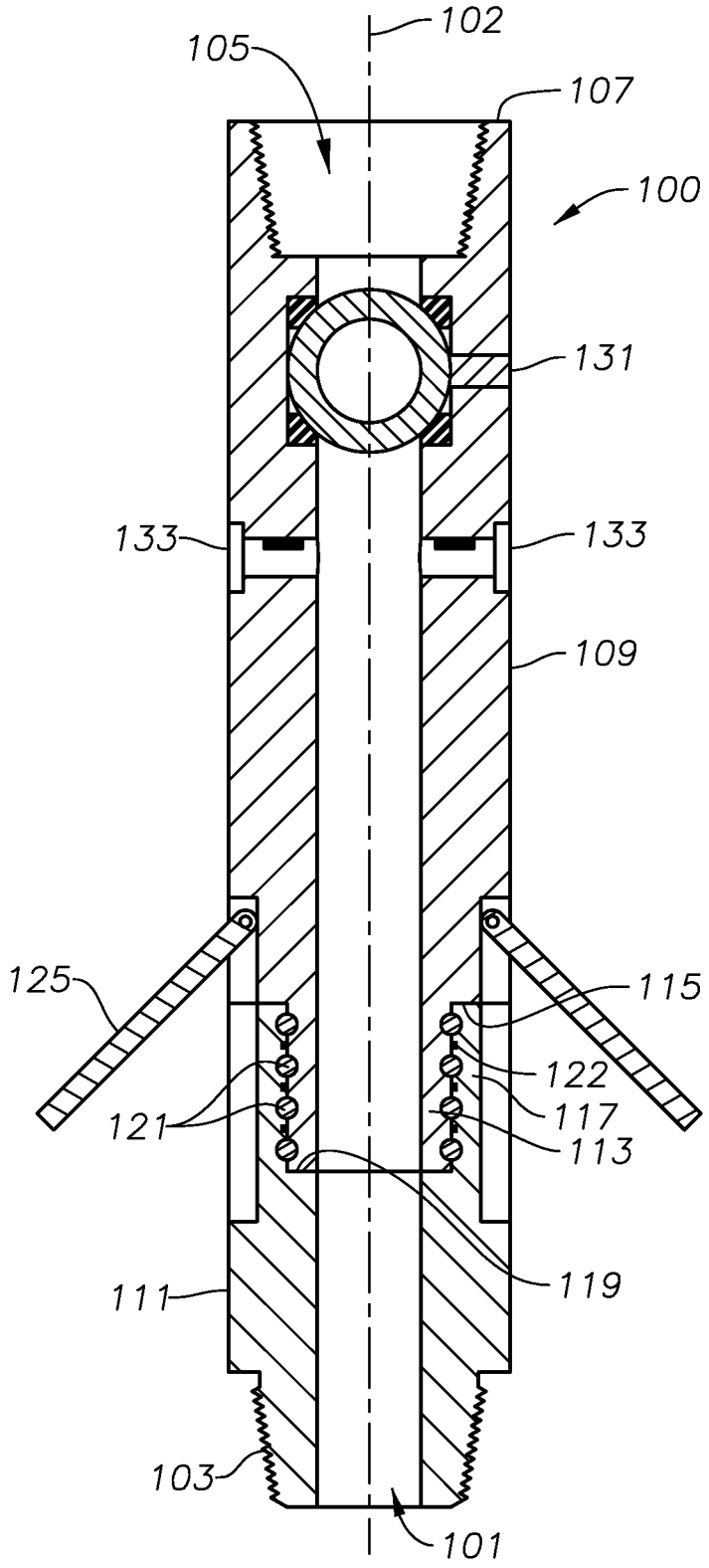
FIG. 3 is a schematic sectional view of the CRT of FIG. 1, illustrating alternative operating positions of components of the CRT of FIG. 1.

As illustrated in FIG. 2A, locking arms 125 each comprise a vertical member 127, a horizontal member 129 formed at an upper end of vertical member 127, and a lower horizontal member 126 formed near a lower end of vertical member 127. Preferably, the upper horizontal member 129 couples to upper tubular member 109 such that locking arms 125 will pivot out of recesses 123 around the upper horizontal member 129. When engaged, as illustrated in FIGS. 1A, 1B, 2A, and 2B locking arms 125 allow for torque transmission between the upper tubular member 109 and the lower tubular member 111. In addition, locking arms 125 provide some axial tensile strength. Locking arms 125 may operate manually or alternatively by remote means such as with a hydraulic actuation system or the like. In the illustrated embodiment CRT 100 has two locking arms 125, but a person skilled in the art will understand that more or fewer locking arms 125 are contemplated and included in the disclosed embodiments.

A portion of vertical member 127 extends beyond horizontal member 126 and defines a recess 134 extending from an exterior vertical edge of vertical member 127 proximate to a recess 128 formed in lower tubular member 111. Recess 128 extends radially inward from the exterior surface of upper tubular member 109 proximate to an edge of recess 123 and the lower end of vertical member 127. A spring 130 and a latching rod 132 reside within recess 128. Latching rod 132 is of a size and shape to allow an end of latching rod 132 to insert into recess 134 of vertical member 127 when locking arm 125 is in the locked position. Spring 130 biases latching rod 132 to insert into recess 134, i.e. a locked position, requiring an operator to actively move latching rod 132 from the locked position shown in FIG. 2A, to the unlocked position shown in FIG. 2B. When in the unlocked position shown in FIG. 2B, locking arm 125 is free to pivot out as shown in FIG. 2C and FIG. 3. In the exemplary embodiment, a cover (not shown) secures over latching rod 132 and spring 130 to prevent potential damage to spring 130 and latching rod 132 when in the drilling environment. A door knob (not shown) then secures to the latching rod and passes through the cover for operation of latching rod 132.

As shown in FIG. 2C, locking arms 125 are biased to the unlocked position by a spring 124 secured to upper tubular member 109 in a spring recess 136 defined in locking arm recess 123. Spring recess 136 extends from the surface of recess 123 radially inward toward central bore 101. In the exemplary embodiment, spring recess 136 is near an upper end of vertical member 127 of locking arm 125 although other positions are contemplated and included by the disclosed embodiments. When locking arm 125 is in the locked position and engaged in recess 123 as shown on the left hand side of FIG. 2C, spring 124 is under compression and exerts a reactive force against locking arm 125. When latching rod 132 (FIG. 2B) is moved to the unlocked position, spring 124 pushes against locking arm 125 and maintains locking arm 125 in the unlocked position until an operator actively locks upper and lower tubular member 109, 111 with locking arms 125 and latching rod 132 (FIG. 2A).

Referring again to FIG. 1A, upper tubular member 109 further comprises a valve 131 proximate to recess 105 and configured to open or close central bore 101. In the illustrated embodiment, valve 131 comprises a manually operated full opening ball valve. A person skilled in the art will understand that valve 131 may operate manually, or alternatively through remote means such as with an electronic or hydraulic actuation system or the like. As illustrated in FIG. 1A, valve 131 is in the open position allowing fluid to flow through central bore 101 and the closed position in FIG. 3, preventing fluid from flowing through central bore 101 past valve 131. A valve stem is accessible through a side wall of upper tubular member 109 for operation of valve 131. In the exemplary embodiment, the valve stem does not extend to the surface of upper tubular member 109 as a safety precaution. A person skilled in the art will understand that other types of valves may be used.

Figure 4A:
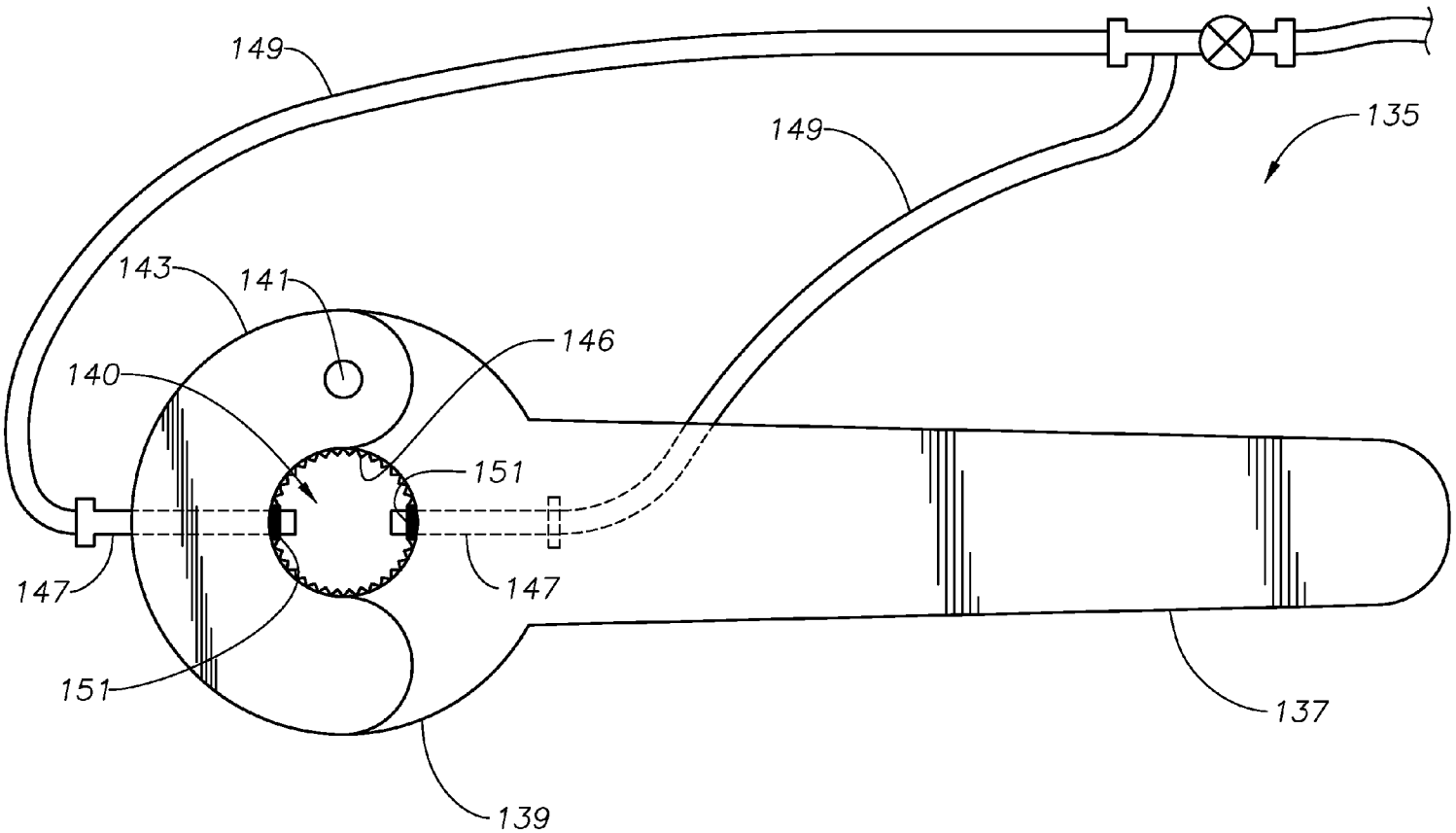
FIG. 4A is a schematic top view of an exemplary injection tool used in conjunction with the CRT of FIG. 1.
Figure 4B:
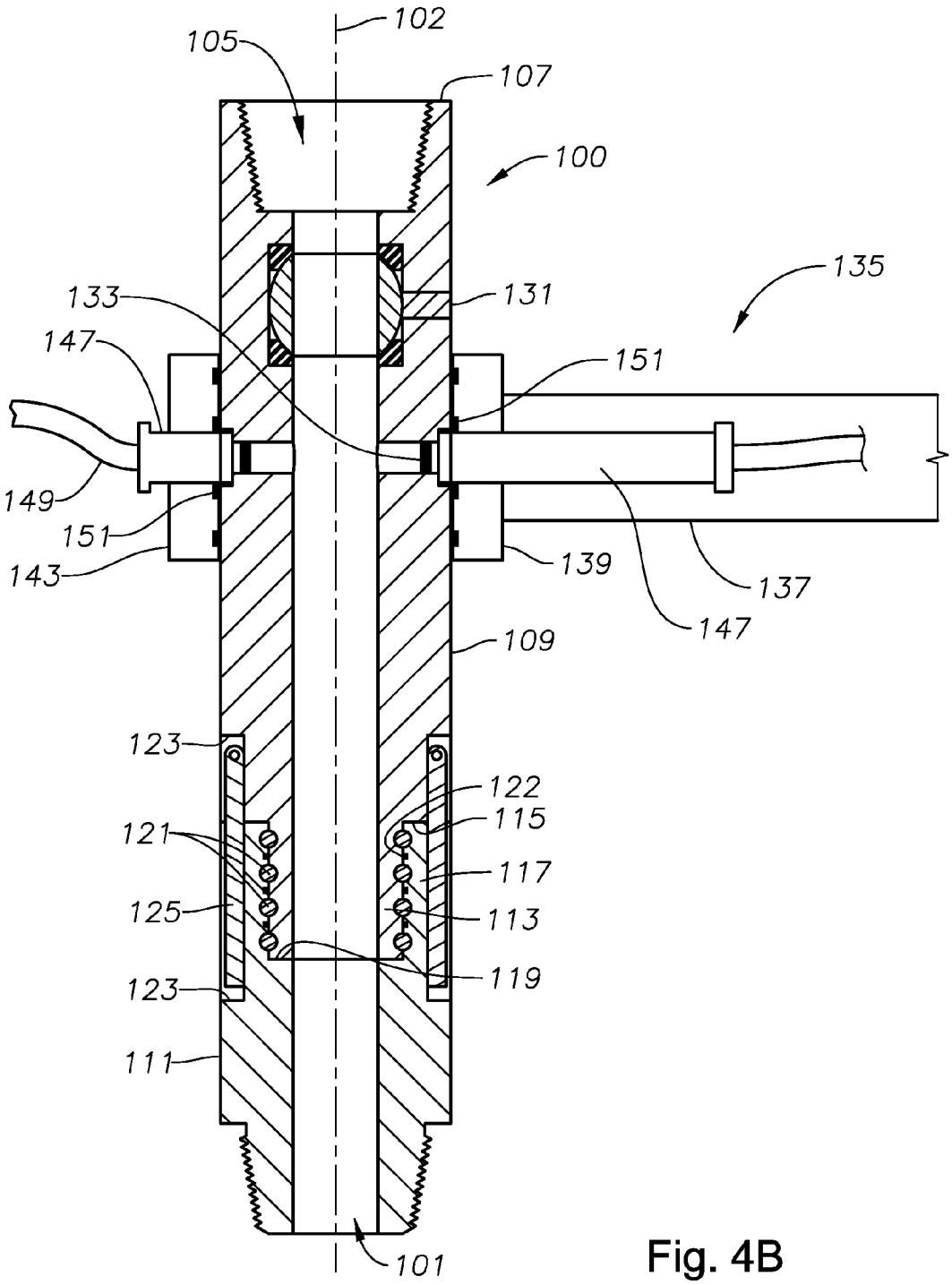
FIG. 4B is a sectional view of the exemplary injection tool clamped to the CRT of FIG. 1A.

Upper tubular member 109 includes at least one port with a check valve 133 proximate to and axially below valve 131. When depressed inward, check valves 133 open to allow drilling fluid to be injected into central bore 101. When rebound, check valves 133 close. In the exemplary embodiment, check valves 133 comprise side entry circulating ports allowing for passage of a fluid one way into central bore 101 through a sidewall port of CRT 100. A portion of the exterior side wall of upper tubular member 109 at check valves 133 is recessed to accommodate a mouth seal 151 (FIG. 4A and FIG. 4B). Check valves 133 are installed in a slotted area of the sidewall of upper tubular member 109 and secured by a stop pin (not shown) to upper tubular member 109. In the exemplary embodiment, check valves 133 are flapper valves biased to the closed position. As illustrated in FIG. 1A, check valves 133 are closed and open in FIG. 3. A single check valve rather than two is feasible. In the exemplary embodiment, two check valves 133 were selected to increase drilling fluid flowrate into central bore 101. Also, rather than a check valve a manually actuable open and close valve is feasible. In an alternative embodiment, as shown in FIG. 1B, check valves 133' are installed so that check valves 133' slant from an upper position at the exterior diameter of upper tubular member 109 to a lower position at central bore 101. The alternative embodiment reduces back pressure from the entry point.

An exemplary CRT 100 is comprised of G-105 or S-135 grade steel and is approximately five feet long with a 4.5 inch IF top and bottom connection. In addition, the exemplary CRT 100 is rated for 26,000 ft-lbs of rotating torque capability and 500,000 lbs tensile strength when locking arms 125 are locked. The valves and central bore can accommodate a 350 gpm pump rate with a rating of 5,000 psi static pressure and 2,500 psi dynamic pressure. When locking arms 125 are unlocked, the engagement of bearings 121 in groove 123 prevents upward movement of upper tubular member 109 relative to lower tubular member 111 due to drilling fluid being pumped through CRT 100.

Referring to FIG. 4A, injection tool 135 comprises a base portion 137 configured to manipulate injection tool 135 into position proximate to upper tubular member 109 as described in more detail below with respect to FIGS. 6-14. A clamping portion 139 couples to an end of base portion 137. Clamping portion 139 is configured to clamp to and grip upper tubular member 109. Clamping portion 139 defines an opening 140 having a diameter approximately equal to the exterior diameter of upper tubular member 109. Clamping portion 139 comprises an outer member 143 configured to swing on pivot 141 to selectively form opening 140. When closed, outer member 143 may latch together and secure with a safety pin (not shown) to prevent inadvertent opening of outer member 143. Clamping portion 139 is configured to secure injection tool 135 to upper tubular member 109 and stabilize injection tool 135 during operation of CRT 100. Clamping portion 139 and outer member 143 may further comprise teeth 146 formed on an axial surface of clamping portion 139 and outer member 143 facing opening 140.

Injection tool 135 further comprises two insert tubes 147 and corresponding mouth seals 151. As illustrated in FIG. 4B, insert tubes 147 are integral to injection tool 135 and are configured to allow injection tool 135 to clamp to upper tubular member 109 both above and below insert tubes 147. A person skilled in the art will understand that insert tubes 147 may be positioned in any suitable location on or around injection tool 135 such that when injection tool 135 secures to and grips upper tubular member 109, as described below, an insert tube 147 will be proximate to a check valve 133. Similarly, the number of insert tubes 147 will correspond with the number of check valves 133 of CRT 100. Preferably, injection tool 135 will secure insert tubes 147 to upper tubular member 109 as shown in FIG. 4B. At each location of an insert tube 147, a mouth seal 151 will couple to insert tube 147 such that, when insert tube 147 stabs into check valve 133, mouth seal 151 will form a seal between the exterior surface of upper tubular member 109 and insert tube 147. As shown in FIG. 4A, drilling fluid hoses 149 couples to each insert tube 147 such that drilling fluid may be pumped from a remotely located reservoir, through hoses 149, through insert tube 147, and into central bore 101. In the exemplary embodiment, drilling fluid hoses 149 are fed by a 2" flux hose that can be connected to a rig standpipe manifold for use of existing rig hydraulic pumping line.

Figure 5:
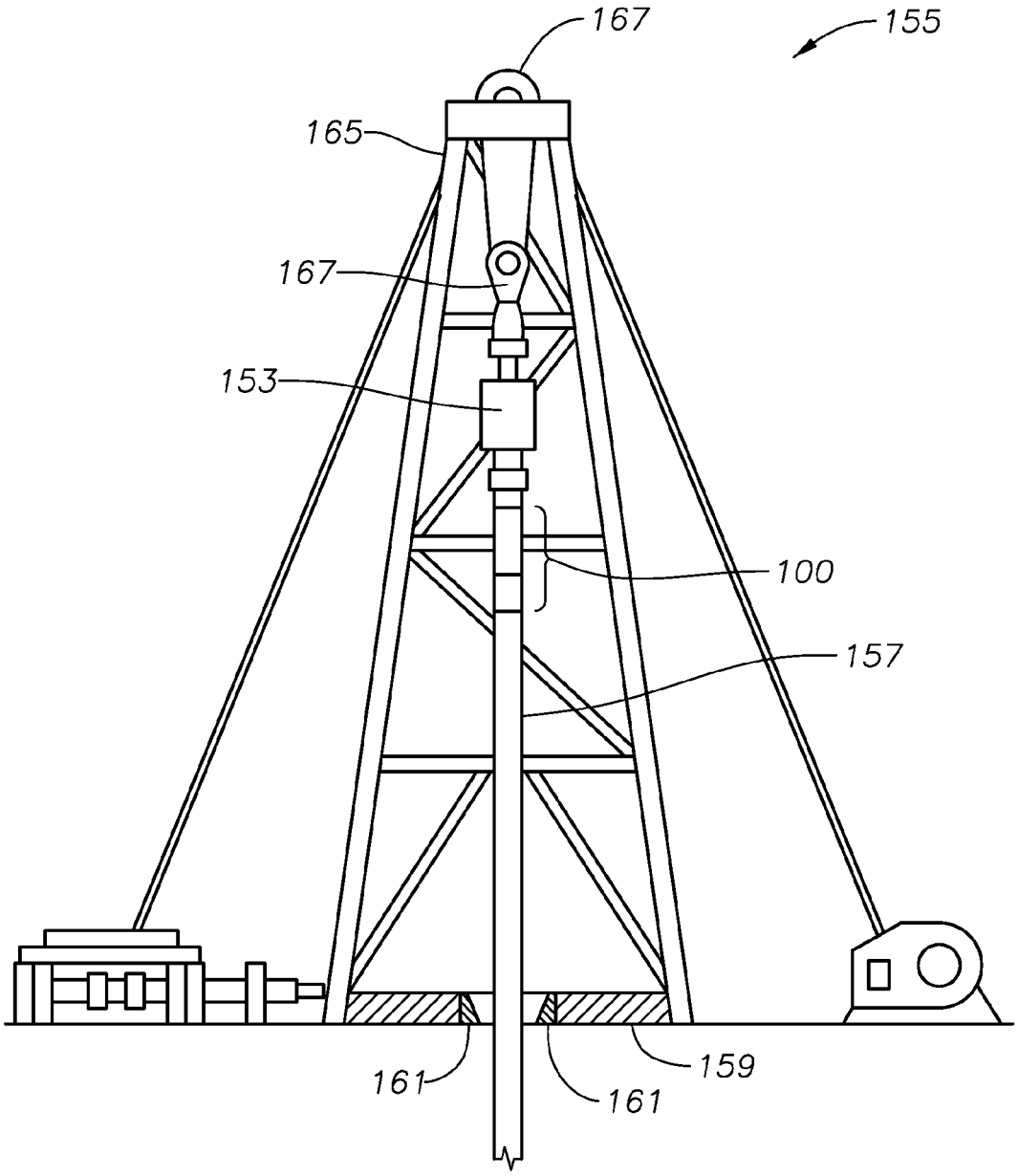
FIG. 5 is a schematic sectional illustration of a CRT coupled to a top drive drilling rig.

During operation of injection tool 135, an operator brings injection tool 135 proximate to upper tubular member 109 as shown in FIG. 4B. Outer member 143 is in an open position, allowing for upper tubular member 109 to be moved radially into opening 140. Check valve 133 is positioned such that as upper tubular member 109 moves radially into opening 140, the insert tube 147 integral to clamping portion 139 will stab into the corresponding check valve 133. Outer member 143 is closed bringing teeth 146 into contact with the exterior surface of upper tubular member 109. The insert tube 147 integral to outer member 143 will insert into the corresponding check valve 133. When outer member 143 closes and latches to clamping portion 139, mouth seals 151 are pressed into sealing contact with the exterior surface of upper tubular member 109 at the corresponding check valves 133. Closure of outer member 143 exerts a compressing force on the exterior of upper tubular member 109. In this manner, teeth 146 will grip upper tubular member 109 preventing rotation of upper tubular member 109 during decoupling of a top drive 153 (FIG. 5).

Operative embodiments of the use of CRT 100 will now be discussed with reference to FIGS. 5-14 and FIGS. 15-23. A person skilled in the art will understand that CRT 100 may be used with multiple types of rig drive systems, such as a top drive system, illustrated in FIGS. 5-14 or a kelly drive system, illustrated in FIGS. 15-23. Referring to FIG. 5, CRT 100 couples to a quill 169 (FIG. 6) of top drive 153 in drilling rig 155. A pipe string 157 couples to CRT 100 opposite top drive 153. Pipe string 157 comprises a plurality of coupled piping elements run into a wellbore having a drill bit coupled to an end of the pipe string 157 at a bottom of the wellbore. Typically, drilling mud pumps through top drive 153, through pipe string 157, and down to the drill bit where the drilling mud cools and cleans the drill bit. Continued pumping of drilling mud through top drive 153 and pipe string 157 forces drilling mud at the bottom of the wellbore back up the wellbore along the outside of pipe string 157, thereby removing drilled material from the wellbore.

As shown, pipe string 157 passes through a rotary table 161 in a rig floor 159. Rig floor 159 comprises an upper platform of drilling rig 155 providing a working space for workers as they perform various functions in the drilling process. Rig floor 159 further comprises a rotary table 161. Rotary table 161 comprises a rotationally driven element within rig floor 159 that, when engaged with pipe string 157 by a plurality of pipe slips 163 (shown in FIGS. 7-12), may hold pipe string 157 stationary within the wellbore, or variably rotate pipe string 157.

Top drive 153 moveably couples to a drilling derrick 165 through a pulley assembly 167 such that top drive 153 may move vertically over rotary table 161 along a rail (not shown), and may rotate both in a clockwise and a counterclockwise direction in order to couple to a subsequent piping element. In the illustrated embodiment, top drive 153 provides the primary means for moving and rotating pipe string 157 and providing fluid to pipe string 157. A person skilled in the art will understand that alternative means of raising and lowering top drive 153, such as hydraulically powered lifts, are contemplated and included by the present embodiments. Drilling derrick 165 will also include an apparatus to position a pipe stand beneath quill 169.

Figure 6:
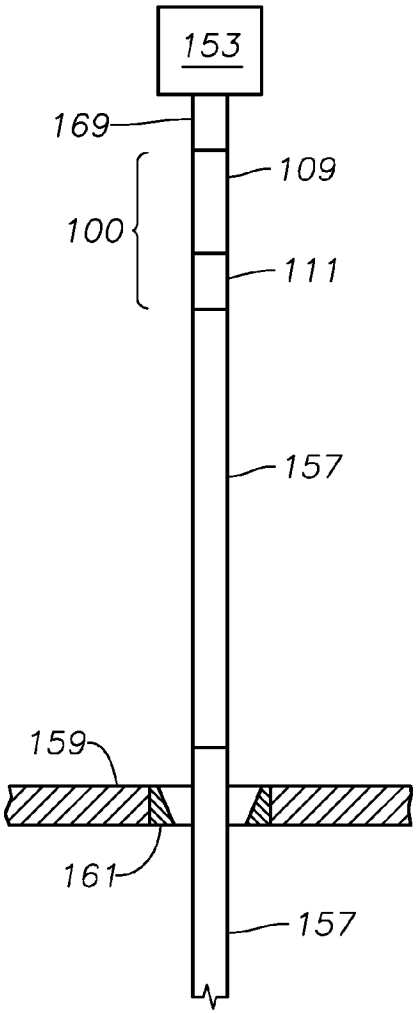
FIGS. 6-14 are schematic sectional illustrations of operational steps of the use of a CRT in accordance with an embodiment of the present invention.

Referring now to FIGS. 6-14, there are shown elements of drilling rig 155 in various operational steps of the use of CRT 100. As used herein, axial movement of pipe string 157 occurs through a combination of lift by pulley assembly 167 and the set down weight of pipe string 157. A person skilled in the art will understand that references to movement of pipe string 157 by top drive 153 refer to movement of pipe string 157 through these forces. As shown in FIG. 6, CRT 100 couples to quill 169 of top drive 153. Quill 169 couples to upper tubular member 109 of CRT 100. Lower tubular member 111 of CRT 100 couples to an upper end of pipe string 157. Pipe string 157 then passes through an opening in rig floor 159 between opposite sides of rotary table 161. Drilling mud pumps through top drive 153 past valve 131 of CRT 100 and into pipe string 157. The elements of CRT 100 of FIG. 1A are in the following positions in FIG. 6. Valve 131 is open to allow circulation of drilling mud past valve 131. Check valves 133 are closed preventing drilling mud from flowing across the sidewall of CRT 100. Locking arms 125 are engaged within recesses 123 such that upper tubular member 109 and lower tubular member 111 rotate as a single body.

Figure 7:
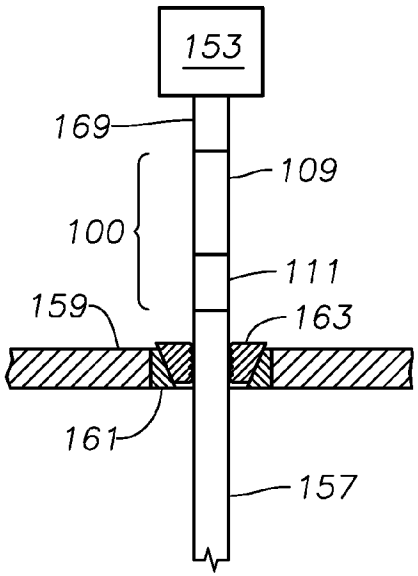
Figure 8:
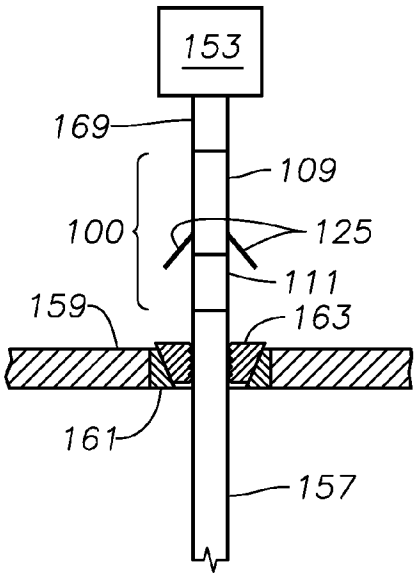

Top drive 153 is then lowered to the position shown in FIG. 7 through normal drilling operations. This brings the upper end of pipe string 157 and CRT 100 proximate to a top surface of rotary table 161. Top drive 153 then stops rotation while a plurality of pipe slips 163 are inserted into a space between pipe string 157 and rotary table 161. Top drive 153 then slightly raises and lowers pipe string 157 to set pipe slips 163. Next, as shown in FIG. 8, while top drive rotation is stopped, the operator pivots locking arms 125 out of recesses 123, thereby disengaging upper tubular member 109 of CRT 100 from lower tubular member 111 of CRT 100. In this manner, lower tubular member 111 may rotate independently of upper tubular member 109 by bearings 121. Rotary table 161 then begins to rotate the engaged pipe string 157 and the coupled lower tubular member 111. Upper tubular member 109 remains stationary. Drilling mud continues to circulate through top drive 153 past valve 131 of CRT 100 into pipe string 157.

Figure 9:
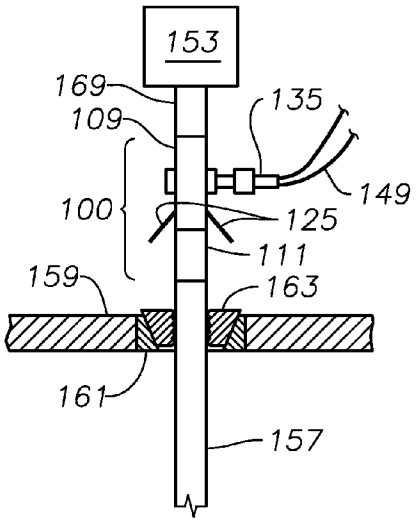

In the embodiment illustrated in FIG. 9, an injection tool 135, having two insert tubes 147 (FIG. 4A) and mouth seals 151 (FIG. 4A) and attached via hoses 149 to a rig pump (not shown), is latched onto upper tubular member 109 at check valves 133. The insert tubes 147 of injection tool 135 insert into check valves 133, thereby opening check valves 133. The interface between the surface of upper tubular member 109 at check valves 133 and injection tool 135 seals by mouth seals 151 of injection tool 135. Valve 131 then closes as drilling mud is pumped through hoses 149 past check valves 133, into central bore 101 of CRT 100 and then into pipe string 157. Pumping of drilling mud through top drive 153 stops while rotary table 161 continues to rotate pipe string 157.

Figure 10:
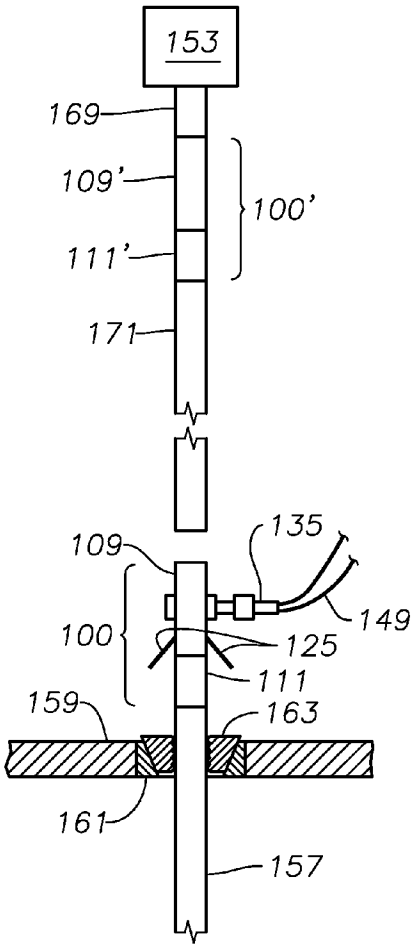

Referring to FIG. 10, injection tool 135 may also have gripping members, such as upper and lower clamping portions 145, 139 of FIG. 4A, to prevent rotation of upper tubular member 109. Injection tool 135 continues to circulate drilling mud through rotating pipe string 157 by way of upper tubular member 109. Injection tool 135 holds upper tubular member 109 stationary as top drive 153 decouples quill 169 from upper tubular member 109, and rotary table 161 rotates lower tubular member 111. Injection tool 135 is linked to drilling rig 153 so as to provide a reacting torque to torque applied to upper tubular member 109 when top drive 153 is unscrewing quill 169 from upper tubular member 109. Alternately, the gripping member reaction torque could be applied by a separate tool from injection tool 135. Drilling rig 155 then manipulates top drive 153 to couple quill 169 to a second CRT 100' that further couples to a stand 171. CRT 100' comprises elements of and operates as CRT 100 as described above with respect to FIGS. 1-3. In the embodiment illustrated in FIG. 10, CRT 100' valve 131' is open, check valves 133' are closed, and locking arms 125' are engaged with recesses 123' causing upper tubular member 109' and lower tubular member 111' to rotate as a single body. Drilling rig 155 then further manipulates top drive 153 to bring stand 171 proximate to upper tubular member 109. Drilling mud continues to circulate through rotating pipe string 157 through CRT 100 as described above.

Figure 11:
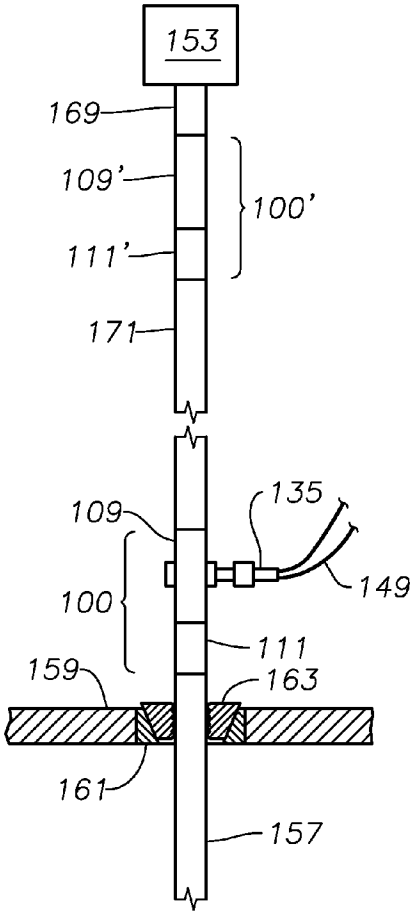
Figure 12:
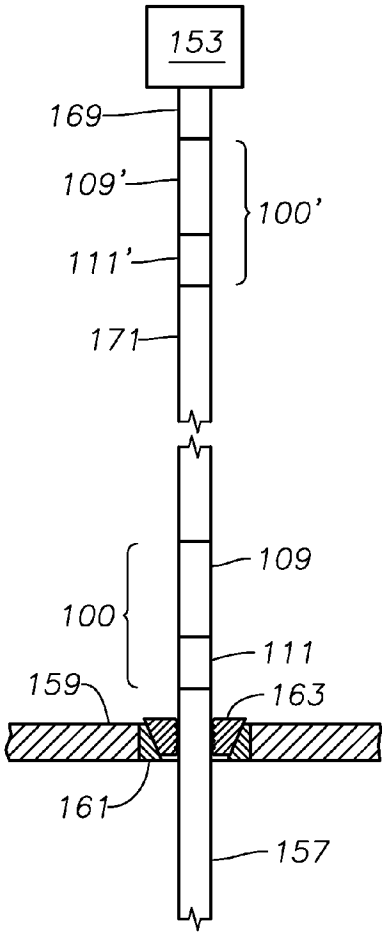

Top drive 153 then couples stand 171 to upper tubular member 109 of CRT 100 as shown in FIG. 11. Once stand 171 couples to upper tubular member 109, rotary table 161 stops rotation of pipe string 157. Locking arms 125 are pivoted into recesses 123 again engaging upper tubular member 109 with lower tubular member 111, preventing independent rotation. Circulation of drilling mud through hoses 149 and injection tool 135 is stopped and injection tool 135 is removed from upper tubular member 109 as shown in FIG. 12. As injection tool 135 is removed, insert tubes 147 withdraw from check valves 133 closing central bore 101 through the sidewall of upper tubular member 109, preventing circulation of drilling mud from central bore 101 through check valves 133. Valve 131 is opened and drilling mud again circulates through top drive 153 into stand 171 and pipe string 157. As illustrated in FIG. 12, valves 131, 131' are open, check valves 133, 133' are closed, and locking arms 125, 125' are engaged.

Figure 13:
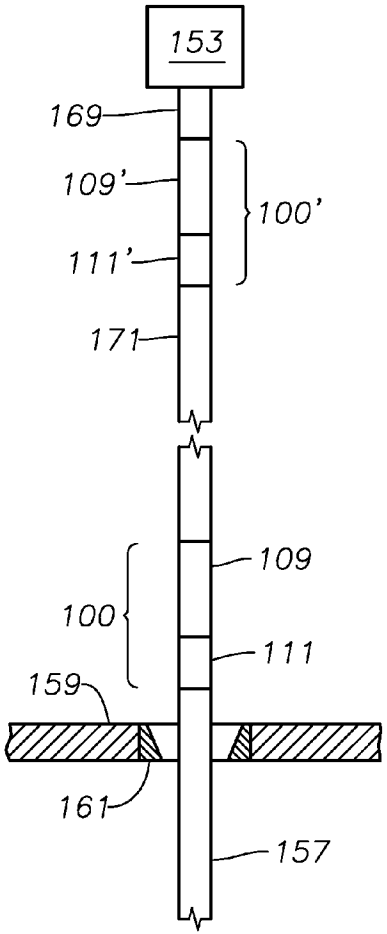
Figure 14:
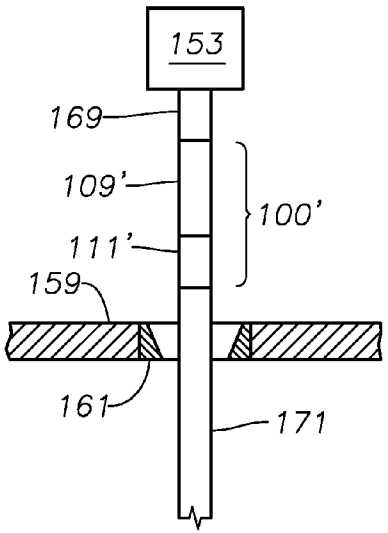

As shown in FIG. 13, top drive slightly lifts pipe string 157 and pipe stand 171, and pipe slips 163 are removed, disengaging pipe string 157 from rotary table 161. Top drive 153 then begins rotating pipe string 157 and stand 171 while circulating drilling mud through pipe string 157 and stand 171. The elements of CRTs 100, 100' are in the positions described with respect to FIG. 12. As illustrated in FIG. 14, drilling rig 155 then lowers top drive 153 toward the wellbore as drilling continues until the upper end of stand 171 and CRT 100' are proximate to a top surface of rotary table 161, where the process repeats as described above.

Figure 15:
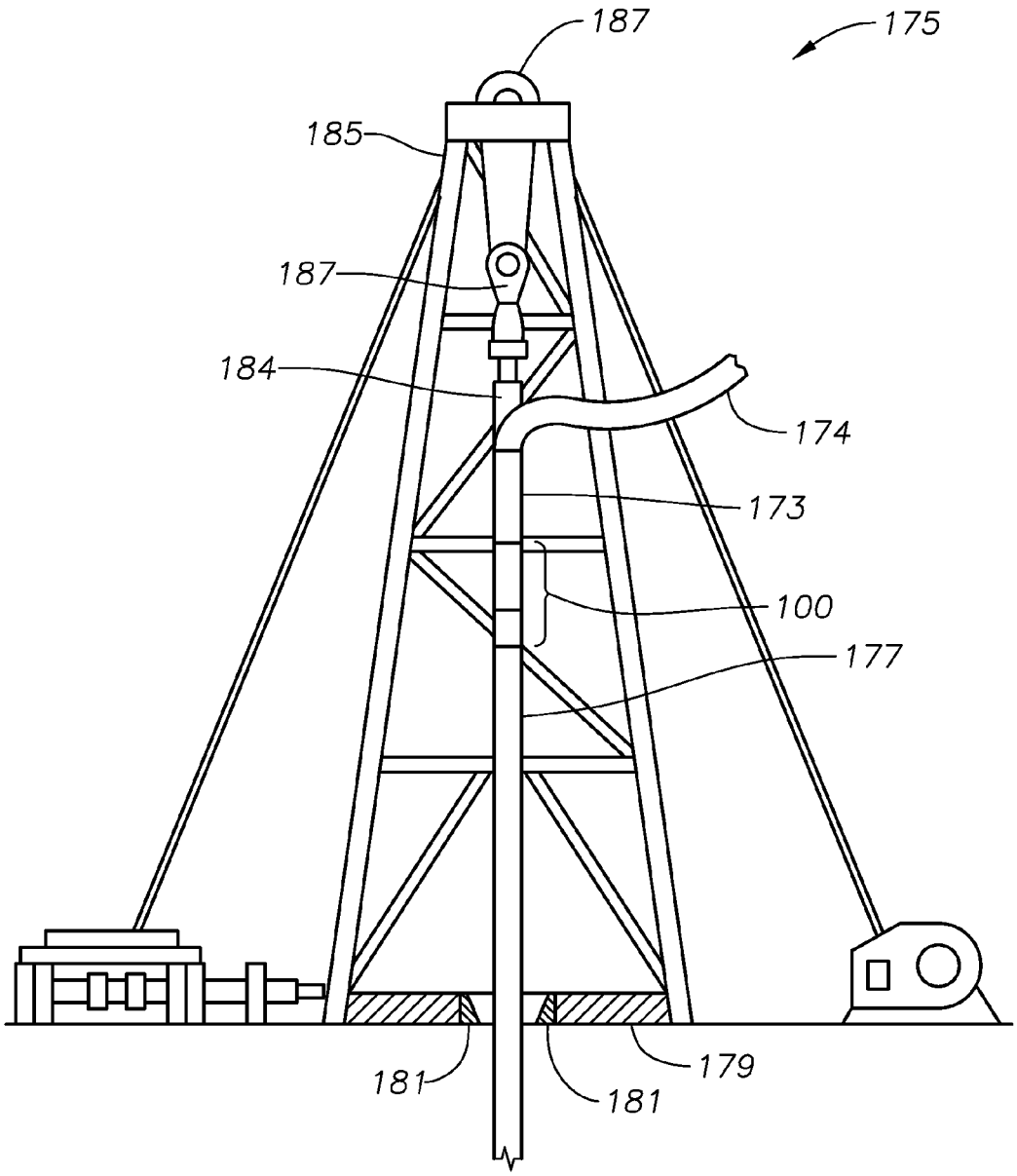
FIG. 15 is a schematic sectional illustration of a CRT coupled to a kelly drive drilling rig.

In an alternative embodiment, CRT 100 may be used with a kelly drive rig as described below with respect to FIGS. 15-23. Referring to FIG. 15, CRT 100 couples to a kelly 173 in drilling rig 175. A pipe string 177 couples to CRT 100 opposite kelly 173. Pipe string 177 comprises a plurality of coupled piping elements run into a wellbore having a drill bit coupled to an end of the pipe string 177 at a bottom of the wellbore. Typically, drilling mud pumps through a kelly hose 174 through kelly 173, through pipe string 177, and down to the drill bit where the drilling mud cools and cleans the drill bit. Continued pumping of drilling mud through kelly 173 and pipe string 177 forces drilling mud at the bottom of the wellbore back up the wellbore along the outside of pipe string 177, thereby removing drilled material from the wellbore.

As shown, pipe string 177 passes through a rotary table 181 in a rig floor 179. Rig floor 179 comprises an upper platform of drilling rig 175 providing a working space for workers as they perform various functions in the drilling process. Rotary table 181 comprises a rotationally driven element within rig floor 179 that, when engaged with pipe string 177 by a plurality of pipe slips 183 (shown in FIGS. 18-21) or with kelly 173 by a plurality of kelly bushings 176 (shown in FIGS. 16 and 23), may rotate pipe string 177.

Kelly 173 moveably couples to a drilling derrick 185 through a pulley assembly 187 such that kelly 173 may move vertically over rotary table 181. A swivel 184 allows kelly 173 to rotate while the elements of pulley assembly 187 remain rotationally stationary. Kelly hose 174 comprises a high pressure flexible hose that carries drilling mud from the drilling mud tank system to kelly 173. In the illustrated embodiment, rotary table 181 provides the primary means for rotating pipe string 177 through kelly 173. Kelly 173 comprises a steel bar having splines or a polygonal outer surface. The outer surface of kelly 173 engages kelly bushings 176. Kelly bushings 176 have a central passage, the interior surface of which mates with the splines or polygonal surface of the outer surface of kelly 173, such that kelly 173 may move axially independent of kelly bushings 176. Kelly bushings 176 are rotated by rotary table 181 and in turn rotate kelly 173. Kelly 173 also provides fluid to pipe string 177. A person skilled in the art will understand that alternative means of raising and lowering kelly 173, such as hydraulically powered lifts, are contemplated and included by the present embodiments. Drilling rig 175 will also include an apparatus to make up a pipe joint beneath Kelly 173 away from rotary table 181 on top of a mouse hole (not shown).

Figure 16:
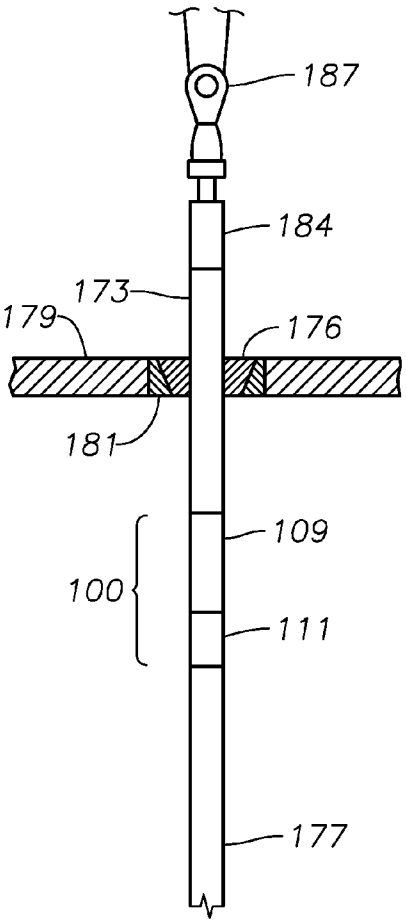

Referring now to FIGS. 16-23, there are shown elements of drilling rig 175 in various operational steps of the use of CRT 100. As used herein, axial movement of pipe string 177 occurs through a combination of lift by pulley assembly 187 and the set down weight of pipe string 177. A person skilled in the art will understand that references to movement of pipe string 177 by kelly 173 refer to movement of pipe string 177 through these forces. As shown in FIG. 16, CRT 100 couples to kelly 173. Kelly 173 couples to upper tubular member 109 of CRT 100. Lower tubular member 111 of CRT 100 couples to an upper end of pipe string 177. As illustrated in FIG. 16, kelly 173 is in the kelly down position. In the kelly down position, the kelly 173 has moved the axial length of the kelly 173 through the kelly bushings 176 during a drilling operation. At this point a new pipe joint must be connected to pipe string 177 to continue drilling.

Drilling mud pumps through kelly 173 past valve 131 of CRT 100 and into pipe string 177. The elements of CRT 100 of FIG. 1A are in the following positions in FIG. 16. Valve 131 is open to allow circulation of drilling mud past valve 131. Check valves 133 are closed preventing drilling mud from flowing across the sidewall of CRT 100. Locking arms 125 are engaged within recesses 123 such that upper tubular member 109 and lower tubular member 111 rotate as a single body.

Figure 18:
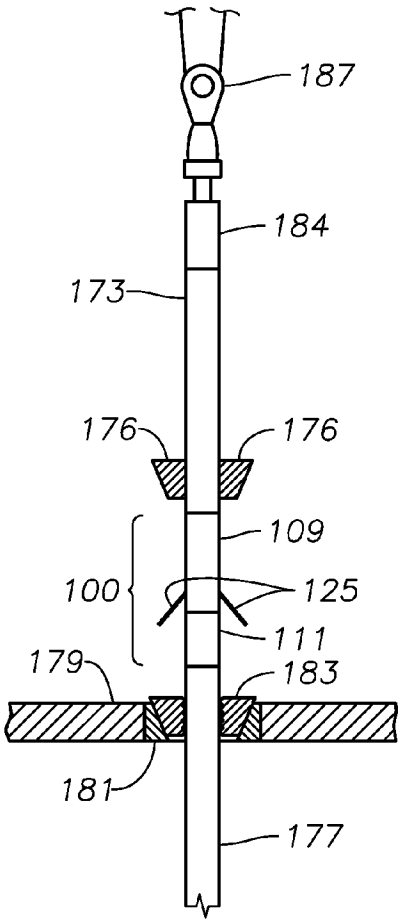
FIGS. 16-23 are schematic sectional illustrations of operational steps of the use of a CRT in accordance with an embodiment of the present invention.
Figure 17:
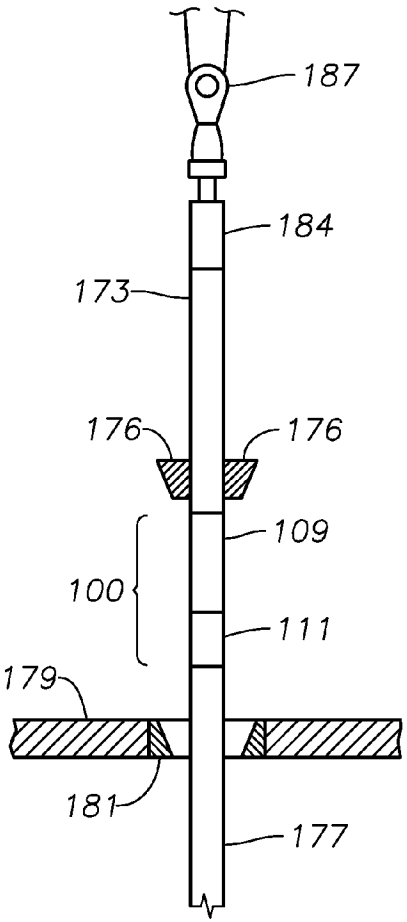

Rotation of kelly 173 stops and kelly bushings 176 and kelly 173 are raised to the position shown in FIG. 17, disengaging Kelly bushings 176 from rotary table 181. This brings the upper end of pipe string 177 and CRT 100 proximate to a top surface of rotary table 181. A plurality of pipe slips 183 are inserted into a space between pipe string 177 and rotary table 171, as shown in FIG. 18. Kelly 173 then slightly raises and lowers pipe string 177 to set pipe slips 183. Next, as shown in FIG. 18, while kelly rotation is stopped, the operator pivots locking arms 125 out of recesses 123, thereby disengaging upper tubular member 109 of CRT 100 from lower tubular member 111 of CRT 100. In this manner, lower tubular member 111 may rotate independently of upper tubular member 109 by bearings 121. Rotary table 181 then begins to rotate the engaged pipe string 177 and the coupled lower tubular member 111. Upper tubular member 109 remains stationary. Drilling mud continues to circulate through kelly 173 past valve 131 of CRT 100 into pipe string 177.

Figure 19:
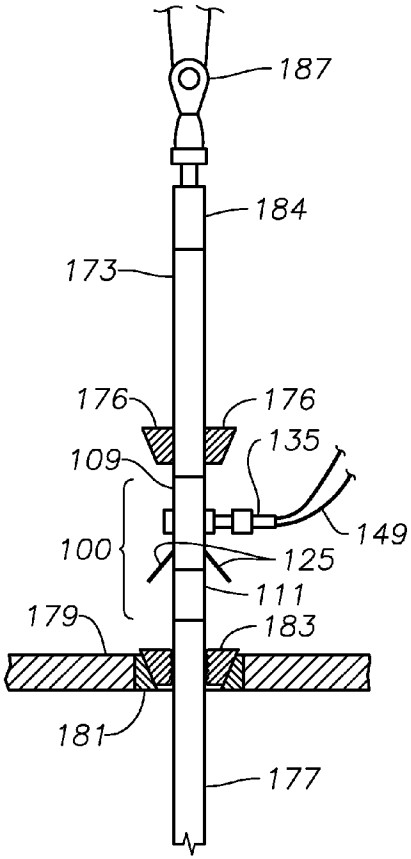

In the embodiment illustrated in FIG. 19, an injection tool 135, having two insert tubes 147 (FIG. 4A) and mouth seals 151 (FIG. 4A) and attached via hoses 149 to a rig pump (not shown), is latched onto upper tubular member 109 at check valves 133. The insert tubes 147 of injection tool 135 insert into check valves 133, thereby opening check valves 133. The interface between the surface of upper tubular member 109 at check valves 133 and injection tool 135 seals by mouth seals 151 of injection tool 135. Valve 131 then closes as drilling mud is pumped through hoses 149 past check valves 133, into central bore 101 of CRT 100 and then into pipe string 177. Pumping of drilling mud through kelly 173 stops while rotary table 181 continues to rotate pipe string 177.

Figure 20:
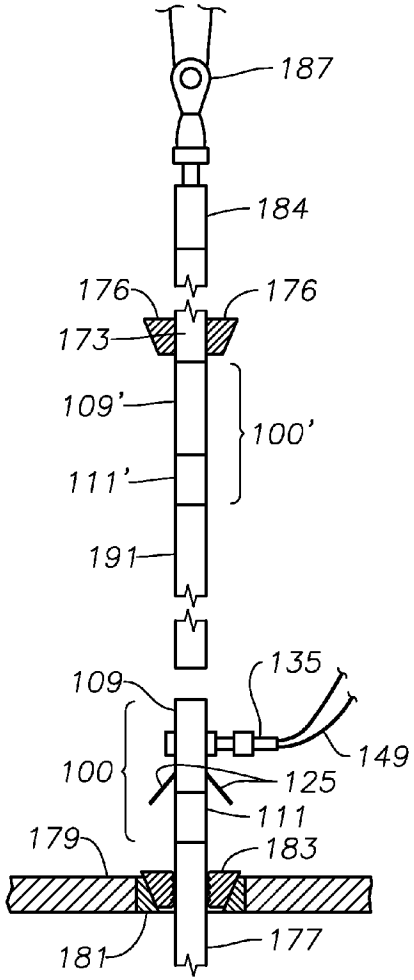

Referring to FIG. 20, injection tool 135 may also have gripping members, such as upper and lower clamping portions 145, 139 of FIG. 4A, to prevent rotation of upper tubular member 109. Injection tool 135 continues to circulate drilling mud through rotating pipe string 177 by way of upper tubular member 109. Injection tool 135 holds upper tubular member 109 stationary as kelly 173 decouples from upper tubular member 109, and rotary table 181 rotates lower tubular member 111. Injection tool 135 is linked to drilling rig 175 so as to provide a reacting torque to torque applied to upper tubular member 109 when kelly 173 is unscrewing from upper tubular member 109. Alternately, the gripping member reaction torque could be applied by a separate tool from injection tool 135. Drilling rig 175 then manipulates kelly 173 to couple to a second CRT 100' that further couples to a pipe joint 191. CRT 100' comprises elements of and operates as CRT 100 as described above with respect to FIGS. 1-3. In the embodiment illustrated in FIG. 20, CRT 100' valve 131' is open, check valves 133' are closed, and locking arms 125' are engaged with recesses 123' causing upper tubular member 109' and lower tubular member 111' to rotate as a single body. Drilling rig 175 then further manipulates kelly 173 to bring pipe joint 191 proximate to upper tubular member 109. Drilling mud continues to circulate through rotating pipe string 177 through CRT 100 as described above.

Figure 21:
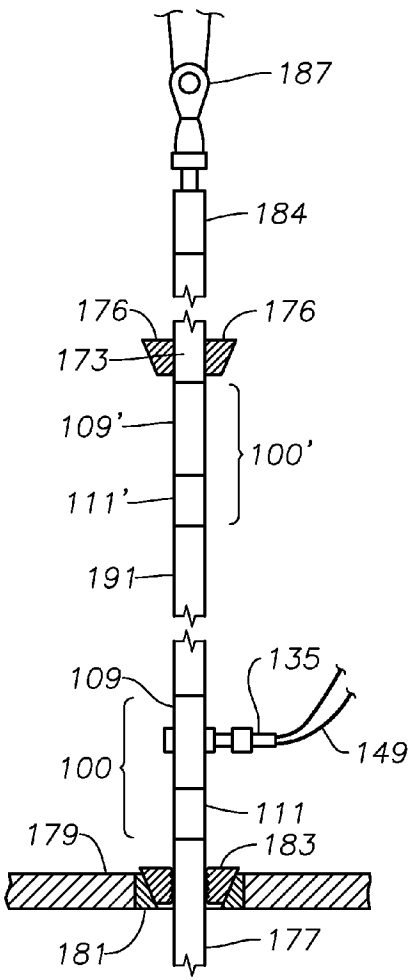
Figure 22:
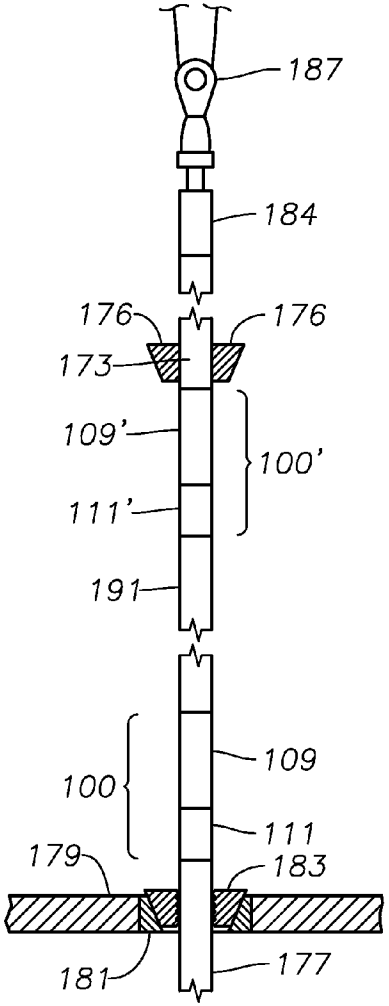

Pipe joint 191 is then coupled to upper tubular member 109 of CRT 100 as shown in FIG. 21. Once pipe joint 191 couples to upper tubular member 109, rotary table 181 stops rotation of pipe string 177. Locking arms 125 are pivoted into recesses 123 again engaging upper tubular member 109 with lower tubular member 111, preventing independent rotation. Circulation of drilling mud through hoses 149 and injection tool 135 is stopped and injection tool 135 is removed from upper tubular member 109 as shown in FIG. 22. As injection tool 135 is removed, insert tubes 147 withdraw from check valves 133 closing central bore 101 through the sidewall of upper tubular member 109 preventing circulation of drilling mud from central bore 101 through check valves 133. Valve 131 is opened and drilling mud again circulates through kelly 173 into pipe joint 191 and pipe string 177. As illustrated in FIG. 22, valves 131, 131' are open, check valves 133, 133' are closed, and locking arms 125, 125' are engaged.

Figure 23:
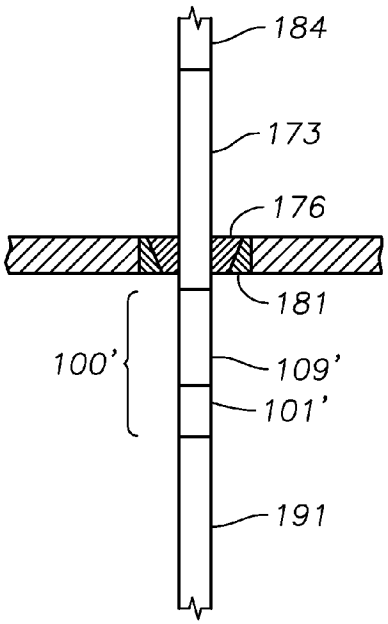

As shown in FIG. 23, kelly 173 slightly lifts pipe string 177 and pipe joint 191, and pipe slips 183 are removed, disengaging pipe string 177 from rotary table 181. Kelly 173 then lowers pipe string 177 and pipe joint 191 while circulating drilling mud through pipe string 177 and pipe joint 191, bringing a lower end of kelly 173 proximate to rotary table 181. Kelly bushings 176 are then inserted into rotary table 181, engaging kelly 173 with rotary table 181. The elements of CRTs 100, 100' are in the positions described with respect to FIG. 22. As illustrated in FIG. 23, drilling rig 175 then continues drilling operations until the upper end of kelly 173 is proximate to a top surface of rotary table 181, where the process repeats as described above.

Figure 24:
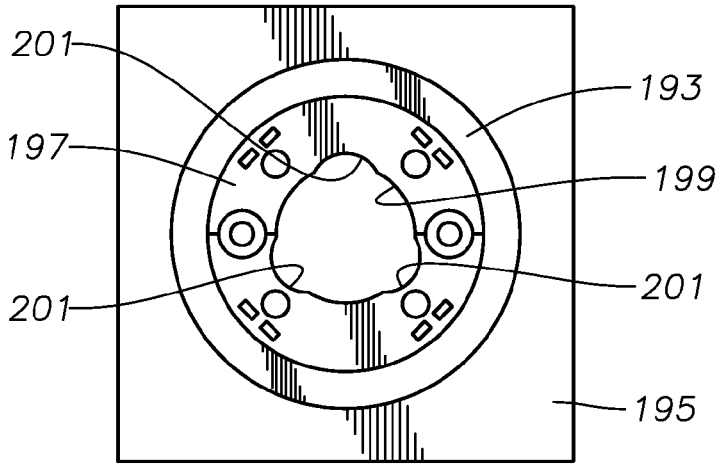
FIG. 24 is a schematic illustration of a modified rotary table in accordance with an embodiment of the present invention.

Referring now to FIG. 24, rotary tables 161, 183 of FIG. 5 and FIG. 15 may be modified as illustrated in FIG. 24. As illustrated in FIG. 24, a rotary table 193 is positioned in a rig floor 195. A rotary table bushing 197 inserts into rotary table 193 and defines a central opening 199. In a typical rotary table bushing, central opening 199 comprises a substantially circular opening into which pipe slips are inserted to grip a pipe string as described above with respect to FIGS. 5-23. Central opening 199 may be conical having a narrower diameter at a lower end of central opening 199. In the embodiment illustrated in FIG. 24, rotary bushing 197 may also define three concavities 201 spaced equidistant around the circumference of central opening 199. Concavities 201 extend from a surface of rotary bushing 197 toward a wellbore located beneath rotary table 193 as illustrated by rotary tables 161, 183 of FIGS. 5 and 15. In the illustrated embodiment, concavities 201 extend the entire length of rotary bushing 197. A person skilled in the art will understand that concavities 201 may extend only a portion of the length of rotary bushing 197 from a surface of rotary bushing 197. Concavities 201 (FIG. 24) may comprise ovoid shaped depressions as illustrated. A person skilled in the art will understand that more or fewer concavities 201 may be included in the disclosed embodiments.

Figure 25:
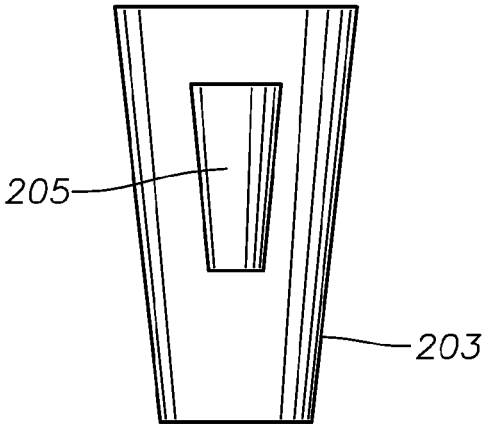
FIG. 25 is a schematic illustration of a modified rotary slip in accordance with an embodiment of the present invention.

Referring now to FIG. 25, a pipe slip 203 for use with rotary table 193 of FIG. 24 is shown. A plurality of pipe slips 203 may insert into opening 199 to secure a pipe string within rotary table 193 for rotation of the pipe string by rotary table 193. In the embodiment illustrated in FIGS. 24 and 25, three pipe slips 203 will be inserted into opening 199 to secure a pipe string in a manner similar to that of pipe slips 163, 183 of FIGS. 5-23. As shown in FIG. 25, each pipe slip 203 includes a protrusion 205 extending from a portion of each pipe slip 203 abutting a surface defining central opening 199 of FIG. 24 when inserted into opening 199. In the illustrated embodiment, pipe slips 203 with protrusions 205 illustrate the exterior surface of a side wall piece of modified rotary slips. These modified rotary slips are typically made of three pipe slips with pipe engaging dice on the inner surface. As shown in FIG. 25, protrusion 205 is of a size and shape such that when pipe slip 203 inserts into opening 199, protrusion 205 will substantially fill a respective concavity 201 of FIG. 24. In the exemplary embodiment of FIG. 25, a surface of protrusion 205 will have a circular or semi-circular exterior surface to abut a surface defining a respective concavity 201.

In operation, a pipe string is inserted into opening 199 in a manner similar to that described above with respect to FIGS. 5-23. Pipe slips 203 are inserted into opening 199 surrounding the pipe string such that a surface of each pipe slip 203 opposite protrusion 205 will abut an exterior surface of the pipe string. Optionally, pipe slips 203 may include engaging dice on the surface abutting the pipe string, providing additional gripping force between pipe slips 203 and the pipe string. Protrusions 205 will insert into concavities 201 such that a surface of each protrusion 205 will abut a respective surface of each concavity 201. When rotary bushing 197 rotates, rotational motion and torque of rotary bushing 197 will transmit through the abutting surfaces of concavities 201 and protrusions 205, causing the gripped pipe string to rotate in response. Typically, pipe slips rely on an interference fit between the pipe string and the rotary bushing to transmit rotational motion of the rotary bushing into rotational motion of the pipe string. In the exemplary embodiment, because pipe slips 203 do not rely solely on an interference fit between rotary bushing 197 and the pipe string, pipe slips 203 are better able to transmit rotational motion of rotary bushing 197 into rotation of the drill string.

Figure 26:
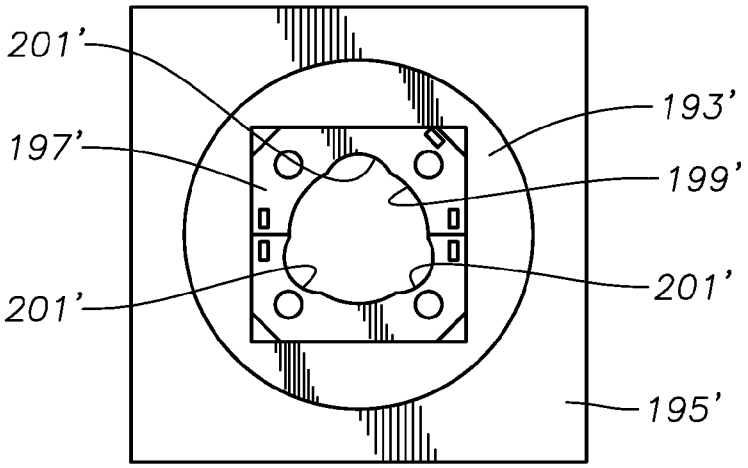
FIG. 26 is a schematic illustration of a modified rotary table in accordance with an embodiment of the present invention.

Referring now to FIG. 26, there is shown an alternative embodiment of the rotary table configuration of FIG. 24. In the exemplary embodiment, rotary table 193' is positioned in a rig floor 195' and utilizes an alternative rotary bushing 197' configured for operation in smaller drilling and workover rigs. Rotary bushing 197' defines an opening 199' and concavities 201' similar to that of FIG. 24. Pipe slips 203 of FIG. 25 may be used with rotary table 193' as described above with respect to FIG. 24 and FIG. 25.

Accordingly, the disclosed embodiments provide numerous advantages over prior devices for circulating drilling mud through a pipe string while continuing rotation of the pipe string. For example, rotation of the pipe string pauses only long enough to engage and disengage the locking arms, attach an injection tool, and close a valve. Compared to earlier prior art methods, the period where the pipe string is not rotating while using the CRT is negligible. In addition, CRT accomplishes near continuous rotation of the pipe string while also allowing for near continuous circulation of drilling mud through the pipe string. In this manner, the present embodiments are able to overcome many of the problems of prior art devices.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A circulation and rotation tool (CRT) for connection into a drill pipe string comprising:

a sub defining a central bore having an axis, the sub having upper and lower ends for connection into a drill pipe string;

wherein the sub comprises a unitary upper tubular member and a lower tubular member;

wherein the unitary upper tubular member and the lower tubular member are configured to selectively rotate independently and in unison depending on the position of a locking member that is biased to a position that allows for independent rotation;

a central bore valve coupled to the unitary upper tubular member to selectively open and close the central bore; and at least one side entry port in a sidewall of the unitary upper tubular member axially below the central valve for selectively allowing drilling fluid to be injected into the central bore.

2. The tool of claim 1, further comprising bearings located between the upper and lower tubular members.

3. The tool of claim 2, wherein:

one of the tubular members comprises a main portion of a first diameter and an annular protrusion that locates within a receptacle of the other tubular member; and the bearings are located between the receptacle and the protrusion.

4. The tool of claim 1, wherein the locking member accessible from an exterior of the sub for selectively locking the upper and lower tubular members together for rotation therewith and transmission of rotational torque between the upper and lower tubular members.

5. The tool of claim 4, wherein the locking member comprises a lever pivotally mounted to one of the tubular members and a recess located on an exterior of the other tubular member to receive the lever.

6. The tool of claim 5, wherein:

the lever pivotally couples to the upper member;

wherein the lever is configured to alternately pivot from a disengaged position to an engaged position;

wherein the engaged position of the lever places the lever across a boundary defined by the upper and lower tubular members;

wherein the recess extends from an exterior surface of each of the upper and lower tubular members, the recess crossing the boundary; and wherein the lever substantially fills the recess when in the engaged position.

7. The tool of claim 5, wherein the lever has a cross member at each end of the arm that locates with a T-shaped portion of the recess to transmit tensile load.

8. The tool of claim 1, wherein the central bore valve comprises a ball valve.

9. The tool of claim 1, wherein the side entry port comprises a check valve that when depressed, allows drilling fluid to be injected through the side entry port into the central bore.

10. The tool of claim 1, further comprising an injection tool adapted to be releasably connected to the side entry port to deliver drilling fluid.

11. In a drilling rig having a top drive configured to pass drilling fluid through and rotate a pipe string, an improvement comprising:

a rotary table mounted in the drilling rig below the top drive, the rotary table configured to suspend and rotate the pipe string;

a sub defining a central bore having an axis, the sub coupled into the pipe string;

wherein the sub comprises:

an upper tubular member and a lower tubular member;

wherein the upper tubular member and the lower tubular member are configured to selectively rotate independently and in unison;

a central bore valve coupled to the upper tubular member to selectively open and close the central bore;

at least one side entry port in a sidewall of the upper tubular member axially below the central valve for selectively allowing drilling fluid to be injected into the central bore;

bearings located between the upper and lower tubular members;

a lever pivotally mounted to one of the tubular members and accessible from an exterior of the sub for selectively locking the upper and lower tubular members together for rotation therewith;

a recess located on an exterior of the other tubular member to receive the lever; and wherein the side entry port comprises a check valve that when depressed, allows drilling fluid to be injected through the side entry port into the central bore.

12. The improvement of claim 11, wherein:

the lever pivotally couples to the upper member;

wherein the lever is configured to alternately pivot from a disengaged position to an engaged position;

wherein the engaged position of the lever places the lever across a boundary defined by the upper and lower tubular members;

wherein the recess extends from an exterior surface of each of the upper and lower tubular members, the recess crossing the boundary; and wherein the lever substantially fills the recess when in the engaged position.

13. The improvement of claim 11, wherein the lever has a cross member at each end of the arm that locates with a T-shaped portion of the recess to transmit tensile load.

14. The improvement of claim 11, wherein:

one of the tubular members comprises a main portion of a first diameter and an annular protrusion that locates within a receptacle of the other tubular member; and the bearings are located between the receptacle and the protrusion.

15. The improvement of claim 11, wherein the rotary table comprises:

a rotary bushing coupled to the rotary table for selectively rotating the pipe string;

the rotary bushing defining a circular opening, wherein the pipe string passes through the opening;

the opening having at least one concavity in a surface defining the opening;

at least one pipe slip configured to insert into the opening between the pipe string and the rotary bushing such that a surface of the pipe slip grips the pipe string;

the pipe slip having a protrusion from an exterior portion of the pipe slip opposite the surface abutting the pipe string;

the protrusion comprising a geometric shape inserted into and substantially filling the concavity, wherein a surface of the protrusion will abut a surface of the concavity when the pipe slip is inserted into the opening; and wherein the rotation of the rotary bushing will transmit to the pipe string through contact between the concavity and the protrusion.

16. A method for circulating fluid through a drill pipe string supported by a rig drive of a drilling rig while rotating the drill pipe string during make up or break out, the method comprising:

(a) connecting a circulation and rotation tool (CRT) to a top of each drill pipe stand used to form a drill pipe string, the CRT having upper and lower portions that are selectively rotatable independently of each other depending on the position of a biased locking member attached to the upper or lower portion;

(b) with the rig drive, positioning the drill pipe string in the drilling rig until the CRT is proximate to and above a rotary table of the drilling rig and continuing to rotate and pump drilling fluid through the top drive and drill pipe string;

(c) engaging the drill pipe string in the rotary table;

(d) rotating the drill pipe string and the lower portion of the CRT with the rotary table while the upper portion of the CRT remains stationary;

(e) closing a central bore valve of the CRT to block flow of fluid from the rig drive;

(f) stabbing an injection tube into a side entry port of the upper portion of the CRT and circulating fluid through the CRT and the drill pipe string;

(g) decoupling the rig drive from the CRT;

(h) coupling another section of pipe between the rig drive and the CRT;

(i) disengaging the pipe string from the rotary table; and (j) continuing operations with the drilling rig.

17. The method of claim 16, wherein step (c) comprises:

pausing rotation of the drill pipe string; and unlocking the locking member coupled to an exterior of the CRT, allowing independent rotation of the upper and lower portions of the CRT.

18. The method of claim 16, wherein step (f) comprises:

latching an injection tool to the side entry port of the CRT; and pumping fluid to the injection tool and through the side entry port of the CRT into the pipe string.

19. The method of claim 16, wherein:

the rig drive comprises a top drive; and step (b) comprises lowering the drill pipe string with the top drive.

20. The method of claim 16, wherein;

the rig drive comprises a kelly drive; and step (b) comprises picking up on a kelly and a kelly bushing until the CRT is proximate to and above the rotary table of the drilling rig and continuing to pump drilling fluid through the kelly and drill pipe string.

* * * * *